US008525759B2

(12) United States Patent
Long et al.

(10) Patent No.: US 8,525,759 B2
(45) Date of Patent: Sep. 3, 2013

(54) VOLTAGE-DRIVING PIXEL UNIT HAVING BLOCKING TRANSISTOR, DRIVING METHOD AND OLED DISPLAY

(75) Inventors: Chunping Long, Beijing (CN); Haoran Gao, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 366 days.

(21) Appl. No.: 12/908,060

(22) Filed: Oct. 20, 2010

(65) Prior Publication Data

US 2011/0090208 A1 Apr. 21, 2011

(30) Foreign Application Priority Data

Oct. 21, 2009 (CN) ..... 2009 1 0236393

(51) Int. Cl.
*G09G 3/30* (2006.01)
*G09G 3/10* (2006.01)

(52) U.S. Cl.
USPC ..... 345/76; 315/169.3

(58) Field of Classification Search
USPC ..... 345/76; 315/169.3
See application file for complete search history.

(56) References Cited

U.S. PATENT DOCUMENTS 6,734,636 B2 * 5/2004 Sanford et al. ..... 315/169.3
6,841,948 B2 * 1/2005 Yoshida ..... 315/169.3
6,876,346 B2 * 4/2005 Anzai et al. ..... 345/76
7,271,785 B2 * 9/2007 Jang ..... 315/169.3
7,564,433 B2 * 7/2009 Hector et al. ..... 345/76
2002/0101394 A1 * 8/2002 Anzai ..... 345/76
2004/0108979 A1 * 6/2004 Seki ..... 345/76
2005/0052365 A1 * 3/2005 Jang ..... 345/76
2005/0237273 A1 * 10/2005 Ozawa et al. ..... 345/76
2006/0012310 A1 * 1/2006 Chen et al. ..... 315/169.3
2006/0077134 A1 * 4/2006 Hector et al. ..... 345/76
2006/0244688 A1 * 11/2006 Ahn et al. ..... 345/76
2007/0063932 A1 * 3/2007 Nathan et al. ..... 345/76
2007/0126680 A1 * 6/2007 Han et al. ..... 345/92
2008/0211746 A1 * 9/2008 Caligiore et al. ..... 345/76

FOREIGN PATENT DOCUMENTS

JP 2007-225653 A * 9/2007
KR 20070057574 A 6/2007

OTHER PUBLICATIONS

KIPO Notice of Allowance, dated Oct. 30, 2012; Appln. No. 10-2010-0102973.

* cited by examiner

*Primary Examiner* — Adam J Snyder
(74) *Attorney, Agent, or Firm* — Ladas & Parry LLP

(57) ABSTRACT

A voltage-driving pixel unit comprises a voltage-driving pixel circuit and an organic light emitting diode (OLED) driven by the voltage-driving pixel circuit is provided. The voltage-driving pixel circuit comprises a gate line, a data line, a power source line, a ground terminal, a switching transistor, a driving transistor, a compensating transistor, a blocking transistor and a storage capacitor.

11 Claims, 4 Drawing Sheets

VOLTAGE-DRIVING PIXEL UNIT HAVING BLOCKING TRANSISTOR, DRIVING METHOD AND OLED DISPLAY

BACKGROUND

Embodiments of the present invention relate to a voltage-driving pixel unit, a driving method and an organic light emitting diode (OLED) display.

One way to achieve an OLED display of a large size is to form an active matrix substrate using thin film transistors. Such substrate comprises a pixel array defined by intersecting of gate lines and data lines. For each pixel of the pixel array, a switch transistor is provided; the gate line supplies a selecting signal to turn on the switch transistor; the data line supplies a voltage signal to a driving transistor in the pixel though the turned-on switch transistor; and the driving transistor drives the OLED in the pixel to emit light. Where the driving transistor is voltage-driven for a long time, stress effect may occur in the driving transistor, and, as a result, the threshold voltage of the driving transistor may drift and the current passing through the driving transistor may correspondingly vary. Since the brightness of the OLED is in proportion to the current, the above variation of the current passing through the driving transistor may result in an uncontrollable variation of the brightness of the OLED and further results in a deterioration of the display quality.

A circuit is designed to compensate the threshold voltage drift of the driving transistor, as shown in FIG. 1. FIG. 1 is a structural view showing a conventional voltage-driving pixel circuit. The voltage-driving pixel circuit in FIG. 1 comprises a switching transistor 201, a compensating transistor 202, a driving transistor 203 and a storage capacitor 204 which constitute a three-transistor-and-one-capacitor (3T1C) structure. In addition, the voltage-driving pixel circuit further comprises a signal line 260 for controlling the compensating transistor 202, a gate line 240, a data line 250, a power source $V_{dd}$ 210 and a ground terminal $V_{ss}$ 220. The voltage-driving pixel circuit is used to drive an organic light emitting diode (OLED) 230 and the operation mechanism is described as follows. Before data is written into the pixel, the cathode voltage $V_{ss}$ is set to a low level, the data line 260 is set to a high level, the driving transistor 203 is turned on, and in this way, a voltage substantially equal to the threshold voltage of the driving transistor 203 is established and temporarily stored in the storage capacitor 204. During the data is written, the data line 260 is set to a low level, the data signal voltage is written (transferred) to the node A, and in this way, the voltage across the storage capacitor 204 becomes $V_{data}+V_{th}$. Next, during sequence for display driving, the cathode voltage $V_{ss}$ of the OLED 230 is set to a low level so that the driving transistor 203 operates in the current saturation region. Because the driving transistor for the OLED 230 operates in the current saturation region, the current passing through the driving transistor is proportional to $(V_{gs}-V_{th})^2$, i.e., $I\propto(V_{gs}-V_{th})^2$, where $V_{gs}$ is the voltage drop between the gate electrode and the source electrode of the driving transistor and $V_{th}$ is the threshold voltage of the driving transistor. In addition, when $V_{gs}$ is equal to the sum of the written data signal voltage ($V_{data}$) and the threshold voltage ($V_{th}$), $I\propto(V_{gs}-V_{th})^2=(V_{data}+V_{th}-V_{th})^2=V_{data}^2$, that is, the current for driving the OLED becomes independent of the threshold voltage. Thus, the drift of the threshold voltage can be compensated.

However, the above-described voltage-driving pixel circuit has the following disadvantage. During the data is written, the driving transistor 203 is in the turned-on state so that the node B is charged and reaches a high level, and thus the voltage across the storage capacitor 204 is decreased; that is, the voltage that is previously equal to the threshold voltage and stored in the storage capacitor before the data is written is decreased. Thus, the effect of compensating the drift of the driving transistor threshold voltage is degraded. Therefore, the current for driving the OLED 230 may still vary, and correspondingly, the brightness of the OLED may vary and the display quality may be deteriorated.

SUMMARY

In an aspect, a voltage-driving pixel unit is provided. The voltage-driving pixel unit comprises a voltage-driving pixel circuit and an organic light emitting diode (OLED) driven by the voltage-driving pixel circuit. The voltage-driving pixel circuit comprises a gate line, a data line, a power source line, a ground terminal, a switching transistor, a driving transistor, a compensating transistor, a blocking transistor and a storage capacitor. The switching transistor is used to control inputting of a data signal voltage from the data line, a gate electrode thereof is connected with the gate line, a drain electrode thereof is connected with the data line and a source electrode thereof is connected with a gate electrode of the driving transistor. The compensating transistor is used to pre-store an instant threshold voltage of the driving transistor to the storage capacitor, a gate electrode thereof is connected with the power source line, a drain electrode thereof is connected with a source electrode of the blocking transistor and a source electrode thereof is connected with source electrode of the switching transistor. The driving transistor is used to provide a driving current to the OLED, a gate electrode thereof is connected with one side of the storage capacitor and a source electrode thereof is connected with the other side of the storage capacitor. The blocking transistor is used to block a connection between the driving transistor and the power source line, both a gate electrode and a drain electrode thereof are connected with the power source line and a source electrode thereof is connected with a drain electrode of the driving transistor.

In another aspect, a driving method for a voltage-driving pixel unit is further provided. The voltage-driving pixel unit comprises a voltage-driving pixel circuit and an organic light emitting diode (OLED) driven by the voltage-driving pixel circuit. The voltage-driving pixel circuit comprises a gate line, a data line, a power source line, a ground terminal, a switching transistor, a driving transistor, a compensating transistor, a blocking transistor and a storage capacitor. The method comprises: step 1 of applying a low level signal to the gate line, respectively applying a voltage signal to the power source line and the ground terminal, thus turning on the compensating transistor and the blocking transistor and charging the storage capacitor to a threshold voltage of the driving transistor; step 2 of applying a high level signal to the gate line and respectively applying a voltage signal to the power source line and the ground terminal, thus rendering the compensating transistor and the blocking transistor in an OFF state, turning on the switching transistor, and writing a data signal voltage from the data line to the storage capacitor; and step 3 of applying a low level signal to the gate line, respectively applying a voltage signal to the power source line and the ground terminal, thus turning on the blocking transistor and driving the OLED to emit light with the voltage stored in the storage capacitor.

In still another aspect, an organic light emitting diode display comprising the above-described voltage-driving pixel unit is further provided, wherein the voltage-driving pixel unit is provided on an array substrate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION

In an embodiment of the invention, a blocking transistor is added to the conventional voltage-driving pixel circuit. The blocking transistor may be connected with the power source line so that the voltage across the storage capacitor is not decreased during the data is written, and thus the compensation to the threshold voltage of the driving transistor can be precisely controlled. Hereinafter, the embodiments of the invention will be described in detail with reference to the accompanying drawings.

Figure 1:
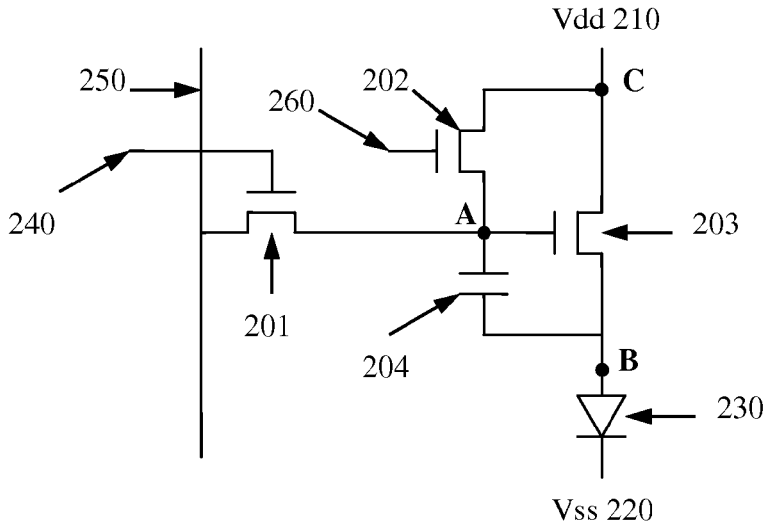
(PRIOR ART) FIG.1
FIG. 1 is a structural view showing a conventional voltage-driving pixel circuit.
Figure 2:
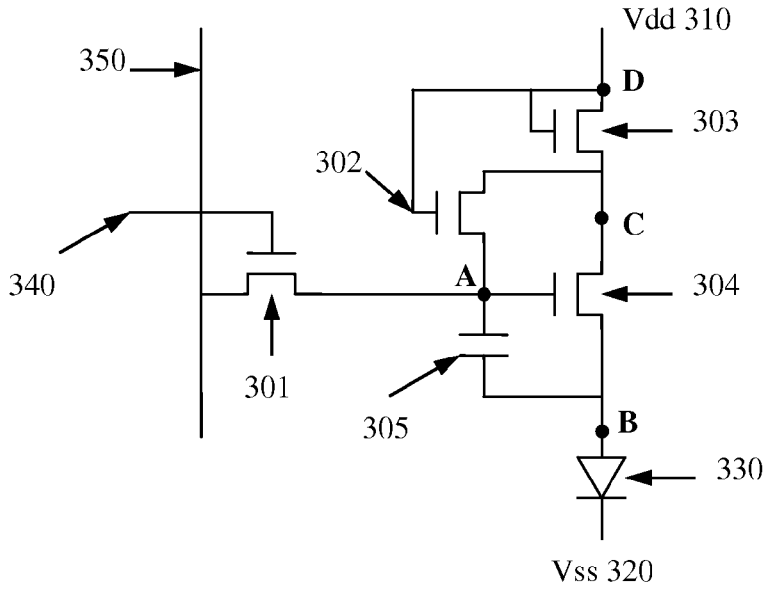
FIG. 2 is a structural view showing a voltage-driving pixel unit according to a first embodiment of the invention.

FIG. 2 is a structural view showing a voltage-driving pixel unit according to a first embodiment of the invention. In this embodiment, a pixel unit in an active matrix organic light emitting diode (AMOLED) display with common cathode is shown as an example.

As shown in FIG. 2, the voltage-driving pixel unit in this embodiment comprises a voltage-driving pixel circuit and an organic light emitting diode (OLED) 330 driven by the voltage-driving pixel circuit. The voltage-driving pixel circuit comprises four N-type transistors, i.e., a switching transistor 301, a compensating transistor 302, a blocking transistor 303 and a driving transistor 304. In addition, the voltage-driving pixel circuit further comprises a storage capacitor 305, a power source line 310, a ground terminal 320, a gate line 340 and a data line 350. The cathode of the OLED 330 is grounded, and the anode of the OLED 330 is connected with a source electrode of the driving transistor 304. A gate electrode of the switching transistor 301 is connected with the gate line 340, a drain electrode of the transistor 301 is connected with the data line 350, and a source electrode of the transistor 301 is commonly connected with one electrode of the storage capacitor 305, a source electrode of the compensating transistor 302 and a gate electrode of the driving transistor 304. The switching transistor 301 is used to supply a data signal voltage from the data line 350 to the storage capacitor 305 and the driving transistor 304 under the control of a selecting signal from the gate line 340. A gate electrode of the compensating transistor 302 and both a gate electrode and a drain electrode of the blocking transistor 303 are connected with the power source line $V_{dd}$ 310. A drain electrode of the compensating transistor 302 is connected with a source electrode of the blocking transistor 303. The compensating transistor 302 is used to compensate the threshold voltage through pre-storing the instant threshold voltage of the driving transistor 304 in the storage capacitor 305 by charging the storage capacitor 305 under the control of the power source signal $V_{dd}$. The blocking transistor 303 is used to prevent the driving transistor 304 from being turned on to charge the node B when the switching transistor 301 is turned on to write the data signal voltage from the data line 350 to the pixel circuit, thus the threshold voltage pre-stored by the compensating transistor 302 will not be deviated. The driving transistor 304 is turned on or off under the control of the voltage across the storage capacitor 305. The source electrode of the driving transistor 304 is connected with the anode of the OLED 330, and the drain electrode of the transistor 304 is connected with the source electrode of the blocking transistor 303. The driving transistor 304 is used to supply a precise driving current to the OLED 330, and the current passing through the driving transistor 304 is controlled by the data signal voltage stored in the storage capacitor 305. The cathode of the OLED 330 is connected with the ground terminal $V_{ss}$ 320. The ground terminal $V_{ss}$ 320 is used as the common cathode in this embodiment and supplies a reference voltage.

The voltage-driving pixel circuit in this embodiment is compatible with a voltage amplitude modulation data-driving chip and/or a pulse width modulation data-driving chip. In addition, the voltage-driving pixel circuit in this embodiment can be produced by using the low-cost, high-reliable and simple amorphous silicon manufacturing process, which facilitates the optimization of the product yield. In addition, in this embodiment, the additional signal line is omitted by employing the modulated power source signal as the control signal of the compensating transistor and the blocking transistor, and thus the layout of the array substrate can be simplified, which facilitates the improvement of the yield of the voltage-driving pixel circuit. In addition, the voltage-driving pixel circuit in this embodiment can employ only same type transistors such as N type amorphous silicon transistors, and thus the manufacture process can be further simplified and the product yield can be further improved.

Figure 3:
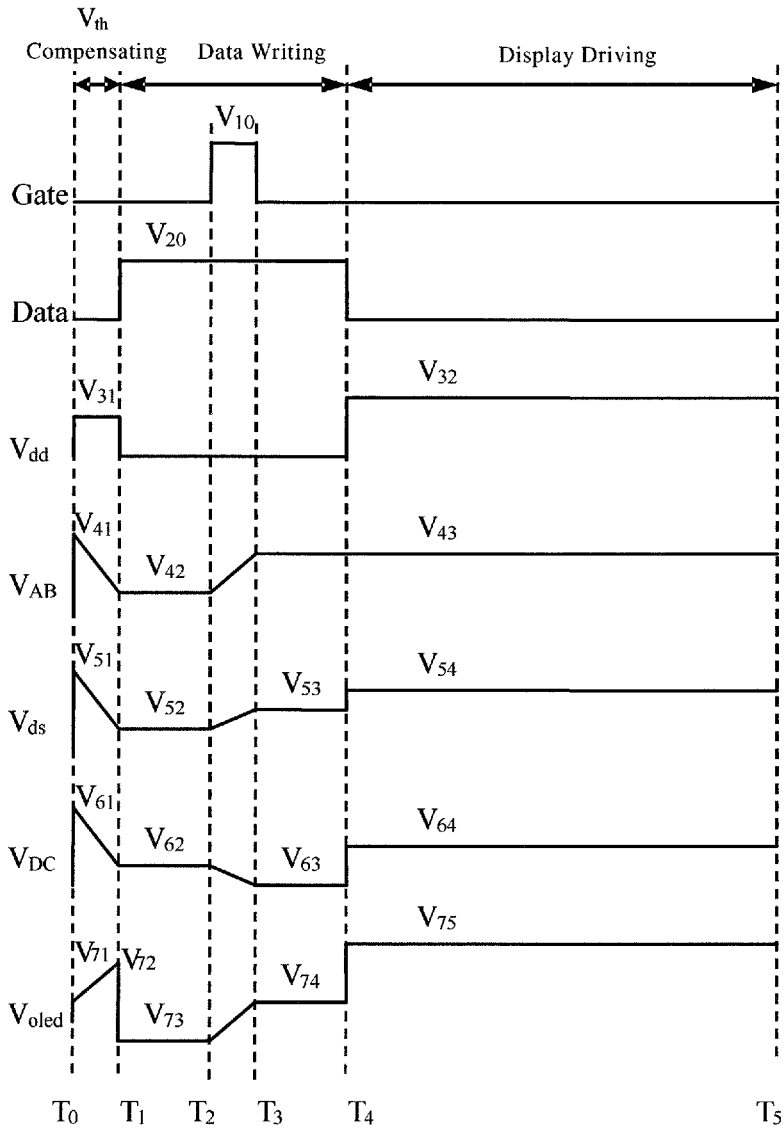
FIG. 3 is a diagram showing a driving sequence of a driving method performing by the voltage-driving pixel unit in FIG. 2.

In addition, a driving method with the above-described voltage-driving pixel circuit in the embodiment is further provided. FIG. 3 is a diagram showing a driving sequence of the driving method with the voltage-driving pixel unit shown in FIG. 2. In the sequence diagram shown in FIG. 3, the following signals during one frame is displayed are illustrated: the selecting signal $V_{10}$ of the gate line 340; the data signal voltage $V_{20}$ of the data line 350, the voltage $V_{dd}$ of the power source line 310 (comprising the control voltage $V_{31}$ for voltage presetting and the control voltage $V_{32}$ for display driving); the voltage $V_{41}$, $V_{42}$ and $V_{43}$ of the voltage $V_{AB}$ across the storage capacitor 305 in three respective sequences (the voltage $V_{AB}$ between the node A on one side of the storage capacitor 305 and the node B on the other side of the storage capacitor, and also the $V_{gs}$ of the driving transistor 304); the voltage $V_{51}$, $V_{52}$, $V_{53}$ and $V_{54}$ of the source-drain voltage of the driving transistor 304 respectively at the initial point and in three sequences, i.e., $V_{ds}$; the voltage $V_{61}$, $V_{62}$, $V_{63}$ and $V_{64}$ of the source-drain voltage of the blocking transistor 303 respectively at the initial point and in three sequences, i.e., $V_{DC}$; the voltage $V_{71}$, $V_{72}$, $V_{73}$, $V_{74}$ and $V_{75}$ of the voltage $V_{oled}$ across the OLED 330 respectively at the initial point and in three sequences. The first discharging prior to the data writing can be performed to eliminate the influence of the previous frame, and the second discharging can be performed after the data writing to eliminate the influence on the next frame. The driving method mainly comprises a compensating sequence (i.e., voltage-presetting sequence), a data-writing sequence and a display driving sequence. The compensating transistor and the blocking transistor are controlled by multi-level voltage signals from the power source line so that the threshold voltage of the driving transistor is pre-stored in the storage capacitor and such pre-stored threshold voltage is kept invariable within the data-writing sequence. Hereinafter, the compensating sequence, the data-writing sequence and the display driving sequence of the driving method are described in detail with reference to FIG. 2 and FIG. 3.

The Compensating Sequence

This sequence is the voltage-presetting stage. In this sequence, when the OLED 330 is in the OFF state (i.e., turned off), an initial voltage substantially equal to the threshold voltage of the driving transistor 304 is preset in the storage capacitor 305. Specifically, as shown in FIG. 3, in the period from the initial point T0 to T1 of the frame, the selecting signal of the gate line 340 is set at a low level so that the switching transistor 301 is in an OFF state. The operation voltage of the power source line 310 is $V_{dd}$, and the power source line 310 supplies a first voltage signal $V_{31}$ to the gate electrode of the compensating transistor 302 and the gate and drain electrodes of the blocking transistor 303. The voltage signal $V_{31}$ is the range of 2~5 V. In this way, the compensating transistor 302 and the blocking transistor 303 are turned on so that the storage capacitor 305 can be temporarily charged to a high level $V_{41}$ larger than the threshold voltage of the driving transistor 304. In addition, the gate electrode and the drain electrode of the blocking transistor 303 are kept to be at the same potential, thus the blocking transistor 303 and the compensating transistor 302 operate in the current saturation region, and thus stable charge current can be provided. In addition, the voltage $V_{AB}$ between the node A on one side of the storage capacitor 305 and the node B on the other side of the storage capacitor equals to the $V_{gs}$ of the driving transistor 304, that is, $V_{AB}=V_{41}=V_{gs}$ (304), and in this way, the driving transistor 304 is turned on. The node B of the storage capacitor 305 is charged by the current passing through the driving transistor 304 so that the potential of the node B is increased and in turn the voltage $V_{AB}$ is decreased. Since the current passing through the driving transistor 304 is proportional to $(V_{gs}-V_{yh})^2$, a current passes through the driving transistor 304 to charge the node B till the voltage $V_{AB}$ is decreased to $V_{th}$. Then, the $V_{AB}$ of the storage capacitor 305 is stably maintained to $V_{th}$. $V_{th}$ substantially equals to the threshold voltage of the driving transistor 304.

It should be noted that, the voltage sequence shown in FIG. 3 is merely a schematic view and may not fully reflect the variation of the voltage $V_{AB}$ stored by the storage capacitor during the period from T0 to T1. For example, depending on the sizes of the transistors and the storage capacitor and the value of the voltage signal, the voltage $V_{AB}$ may reach the $V_{th}$ prior to T1 or at T1; these two cases are within the spirit and scope of the invention. In addition, it should be noted that, the initial threshold voltage is about 1.5V~2.5 V for the N-type amorphous silicon transistor, and the threshold voltage of such transistor may drift to even 10 V due to the stress effect resulted from long-time operation. The pixel circuit in this embodiment can compensate such drift of the threshold voltage. In FIG. 3, the variation of the source-drain voltag e $V_{ds}$ of the driving transistor 304, the variation of the source-drain voltage $V_{DC}$ of the blocking transistor 303 and the variation of the voltage $V_{oled}$ of the organic light emitting diode are shown as well. The blocking transistor 303 and the compensating transistor 302 are in the current saturation region, and their source-drain voltages $V_{ds}$ are larger or equal to $V_{gs}-V_{th}$. Similar to the above variation process of the voltage $V_{AB}$, the voltage $V_{ds}$ transits from the transient voltage $V_{51}$ at the time when the voltage signal $V_{31}$ is supplied to the stable voltage $V_{52}$, and the voltage $V_{DC}$ transits from the transient voltage $V_{61}$ at the time when the voltage signal $V_{31}$ is supplied to the stable voltage $V_{62}$. In addition, since the voltage $V_{oled}$ satisfies the relationship: $V_{oled}+V_{ds}+V_{DC}=V_{dd}$, the voltage $V_{oled}$ is increased from $V_{71}$ to $V_{72}$. At the time of T1, the supply of the high level voltage signal $V_{31}$ from the power source line 310 is stopped, and the pre-charging of the pixel circuit and the compensation of the threshold voltage are completed.

In addition, before the compensating voltage is preset into the storage capacitor 305, that is, at the initial stage of writing the threshold voltage into the storage capacitor 305, a reverse bias may be supplied to the OLED 330. Specifically, the power source line 310 temporarily supplies a high level signal, and the voltage larger than the threshold voltage of the driving transistor 304 is established and stored in the storage capacitor 305; then the cathode voltage Vss of the OLED 330 is set to a high level, and the voltage Vdd of the power source line 330 is set to a low level. The OLED 330 is reversely biased, and the driving transistor 304 is turned on so that any residual charges or voltage from the previous frame can be eliminated. Since the OLED 330 is a thin film device, charges are easily accumulated under a forward bias; when the reverse bias is applied to the OLED 330, the accumulated charges can be eliminated and the OLED 330 can operate under a low voltage.

The Data-Writing Sequence

When the voltage $V_{dd}$ of the power source line 310 is set to a low level (or no voltage signal is transmitted over the power source line 310), the blocking voltage 303 is in an OFF state, preventing current from passing through the driving transistor 304 to charge the node B of the storage capacitor, and accordingly, it is prevented that the pre-stored threshold voltage drifts. At this time, the pixel circuit is set into the operation state, that is, the data signal voltage from the data line 350 is supplied to the pixel. Specifically, in the sequence when the data signal voltage is written, the data signal voltage $V_{20}$ is supplied to the data line 350 during the period from T1 to T4, and the high level voltage $V_{10}$ is supplied to the gate line 340 during the period from T2 to T3. In this case, the switching transistor 301 is turned on by the high level voltage $V_{10}$ of the gate line 340, and the date signal voltage from a driving chip is written into the pixel circuit in the form of the current passing through the data line 350. Since the impedance of the switching transistor 301 is low after it is turned on, the resultant current loss can be kept low, and thus the potential at the node A is substantially consistent with the data signal voltage $V_{data}$ from the data line 340. At this time, the voltage $V_{dd}$ of the power source line 310 is at a low level and smaller than $V_{ss}$+2V (i.e., $V_{dd}<V_{ss}+2V$), and the OLED 330 is in an OFF state. When the voltage across the OLED 330 is smaller than 2V, the OLED 330 generally is in an OFF state and not turned on. When the voltage $V_{dd}$ of the power source line 310 is set to a low level, the OLED 330 is not or substantially not turned on, and at this time, the voltage across the OLED 330 may be in a forward-biased or reverse-biased state depending on the value of the voltage $V_{dd}$, the size of the devices in the pixel circuit, and the size and material of the OLED 330. At this time, the OLED 330 can be regarded as a capacitor; the current passing through the OLED 330 is very low and thus has little influence on the process of writing the signal into the pixel circuit. In addition, since the voltage $V_{dd}$ from the power source line 310 is at a low level, both the compensating transistor 302 and the blocking transistor 303 are in an OFF state, and thus substantially no leakage current passes through the driving transistor 304 and the node B is substantially not charged. In the data-writing sequence, since the OLED 330 is regarded as a capacitor and the blocking transistor 303 is in an OFF state as described above, the node B can be kept at the stable preset potential, and thus the voltage $V_{AB}$ across the storage capacitor 305 can be equal to the sum of the data signal voltage and the preset threshold voltage. As shown in FIG. 3, the stored voltage $V_{AB}=V_{43}=V_{42}+V_{data}=V_{th}+V_{data}$, that is, the data signal voltage is added to the preset voltage in the storage capacitor.

It should be noted that, the voltage sequence shown in FIG. 3 is merely a schematic view and may not fully reflect the variation of the voltage $V_{AB}$ of the storage capacitor during the period from T2 to T3. For example, depending on the sizes of the transistors and the storage capacitor and the value of the voltage signal, the voltage $V_{AB}$ may reach the stable $V_{th}+V_{data}$ prior to T3 or at T3. In addition, in the data-writing sequence, the voltage across the OLED 330 is smaller than 2V, and the OLED 300 is in an OFF state. Although the capacitive impedance of the OLED 330 is almost ten times larger than that of the storage capacitor 305, a small potion of the voltage across the storage capacitor 305 is applied across the OLED 330, and thus the data signal voltage on the storage capacitor is generally decreased by about 5%. In FIG. 3, the variation of the source-drain voltage $V_{ds}$ of the driving transistor 304, the variation of the source-drain voltage $V_{DC}$ of the blocking transistor 303, the variation of the voltage $V_{oled}$ of the OLED 330 during the period from T1 to T4 are shown as well. The variations of $V_{ds}$ and $V_{DC}$ are incurred by the parasitic capacitances of the driving transistor 304 and the blocking transistor 303, respectively. The voltage of the OLED 330 varies according to the relationship: $V_{oled}=V_{dd}-V_{DC}-V_{ds}$. In addition, it also should be noted that, the parasitic capacitances of the driving transistor 304 and the blocking transistor 303 have no influences on the process of writing the data signal voltage into the pixel circuit because both the blocking transistor 303 and the driving transistor 304 are not directly connected with the node B.

The Display Driving Sequence

In the display driving sequence, the driving current provided through the driving transistor only depends on the data signal voltage stored in the storage capacitor and is not related to the threshold voltage of the driving transistor. In the display driving sequence, the power source line 310 supplies a high-level signal $V_{dd}$, and thus the OLED 330 is driven to emit light. Specifically, at the initial point T4 of the display-written sequence, the voltage $V_{dd}$ of the power source line 310 is set to a high-level voltage $V_{32}$. At this time, the voltage $V_{dd}$ is required to supply the driving current and operation voltage to the blocking transistor 303, the driving transistor 304 and the OLED 330, and thus the voltage $V_{dd}$ is generally set in the range of 20~30 V. The blocking transistor 303 is turned on so that a current path for the driving current is formed. The driving current I flows into the OLED 330 through the driving transistor 304. The potential at the node C in the pixel circuit is slightly smaller than the power source voltage $V_{32}$ because of a small voltage drop on the blocking transistor 303. The voltage $V_{gs}$ of the driving transistor 304 is provided by the voltage $V_{AB}$ stored in the storage capacitor, that is, $V_{gs}=V_{data}+V_{th}$. The voltage $V_{ds}$ of the driving transistor 304 satisfies the relationship: $Vds\approx V_{32}-V_{AB}>V_{gs}-V_{th}=V_{data}$, and thus the driving transistor 304 operates in the current saturation region. In addition, the driving current I provided to the OLED 330 satisfy the relationship: $I\propto(V_{gs}-V_{th})^2=(V_{data}+V_{th}-V_{th})^2=V_{data}^2$. That is, the driving current for the OLED 330 is merely associated with $V_{data}^2$. Therefore, since the brightness of the OLED 330 is proportional to the driving current passing through it, the brightness of the OLED 330 is merely associated with the data signal voltage $V_{data}$.

According to the above-described driving method, a relationship between the voltage signal and the driving current is established regardless of the threshold voltage of the driving transistor 304, that is, the driving current provided to the OLED 330 through the driving transistor 304 is not associated with the threshold voltage. As shown in FIG. 3, in the display driving sequence, the source-drain voltage of the blocking transistor 303 is $V_{64}$, the source-drain voltage of the driving transistor 304 is $V_{54}$, and the voltage $V_{oled}$ applied across the OLED 330 satisfies the relationship: $V_{75}=V_{32}-V_{64}-V_{54}$, which is larger than or equal to the turned-on voltage (~2V) of the OLED 330 and depends on the driving current of the driving transistor 304. The brightness of the OLED 330 is proportional to the driving current of the driving transistor 304.

According to the above-described driving method, the influence of the data signal voltage on the threshold voltage that is pre-stored in the storage capacitor can be alleviated to a most degree by blocking the connection between the driving transistor and the power source line with the blocking transistor in the data-writing sequence, and thus the threshold voltage preset in the storage capacitor can be stably maintained and the data signal voltage can be precisely written. In addition, since the influence of the data signal voltage on the threshold voltage preset in the storage capacitor is alleviated during the data-writing sequence, the accuracy of the threshold voltage preset in the storage capacitance can be maintained, and the accuracy of the data signal voltage for controlling the brightness of the OLED can be maintained as well. In addition, since the driving current of the driving transistor is not associated with the threshold of the driving transistor, the brightness of the OLED merely depends on the data signal voltage, and the influence of the threshold voltage variation on the driving current and the brightness of the OLED can be reduced, especially the influence of the drift of the threshold voltage by the stress effect resulting from long-time operation of the driving transistor can be greatly reduced.

Figure 4:
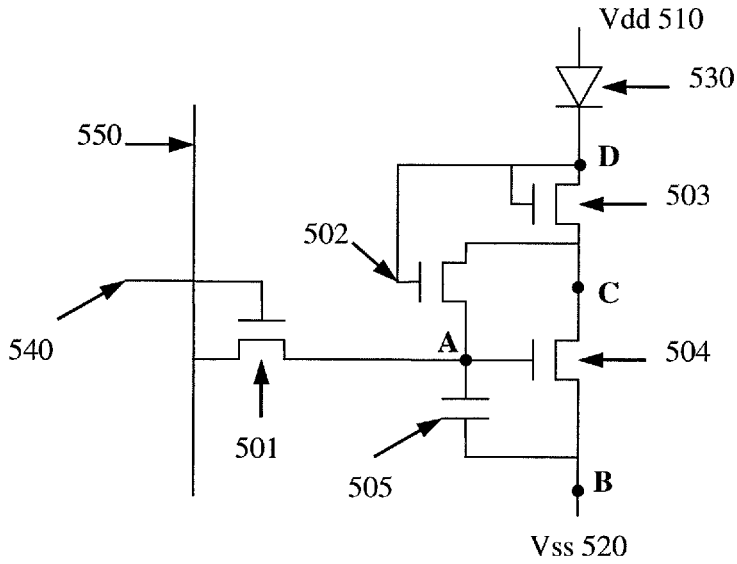
FIG. 4 is a structural view showing a voltage-driving pixel unit according to a second embodiment of the invention.

FIG. 4 is a structural view showing a voltage-driving pixel unit according to a second embodiment of the invention. In this embodiment, a pixel unit in an AMOLED display with common anode is shown as an example.

As shown in FIG. 4, the voltage-driving pixel unit in this embodiment comprises a voltage-driving pixel circuit and an OLED 530 driven by the voltage-driving pixel circuit. The voltage-driving pixel circuit comprises four N-type transistors, i.e., a switching transistor 501, a compensating transistor 502, a blocking transistor 503 and a driving transistor 504. In addition, the voltage-driving pixel circuit further comprises a storage capacitor 505, a power source line 510, a ground terminal 520, a gate line 540 and a data line 550. The anode of the OLED 530 is connected with the power source line 510, and the cathode of the OLED 530 is connected with a drain electrode of the blocking transistor 503.

A gate electrode of the switching transistor 501 is connected with the gate line 540, a drain electrode of the transistor 501 is connected with the data line 550, and a source electrode of the transistor 501 is connected with one side of the storage capacitor 505, a source electrode of the compensating transistor 502 and a gate electrode of the driving transistor 504. A gate electrode of the compensating transistor 502 and both a gate electrode and a drain electrode of the blocking transistor 503 are connected with the cathode of the OLED 530. A drain electrode of the compensating transistor 502 is connected with a source electrode of the blocking transistor 503. The blocking transistor 503 is used to prevent the driving transistor 504 from being turned on to charge the node B when the switching transistor is 501 is turned on to write the data signal voltage from the data line 550 to the pixel circuit, so that the threshold voltage pre-compensated by the compensating transistor 502 will not be deviated. The driving transistor 504 is turned on or off under the control of the voltage across the storage capacitor 505. The source electrode of the driving transistor 504 is connected with the other side of the storage capacitor 505, and the drain electrode of the transistor 504 is connected with the source electrode of the blocking transistor 503 and the drain electrode of the compensating transistor 502. The functions of the transistors 501 to 504 are similar to those in the first embodiment.

In addition, the effects and advantages of the voltage-driving pixel circuit in this embodiment are similar to those of the first embodiment. The additional signal line is omitted by employing the modulated power source signal as the control signal of the compensating transistor and the blocking transistor, and thus the layout of the array substrate can be simplified, which facilitates the improvement of the yield of the voltage-driving pixel circuit. In addition, the voltage-driving pixel circuit in this embodiment can employ only same type transistors such as N type amorphous silicon transistors, and thus the manufacture process can be further simplified and the product yield can be further improved.

Figure 5:
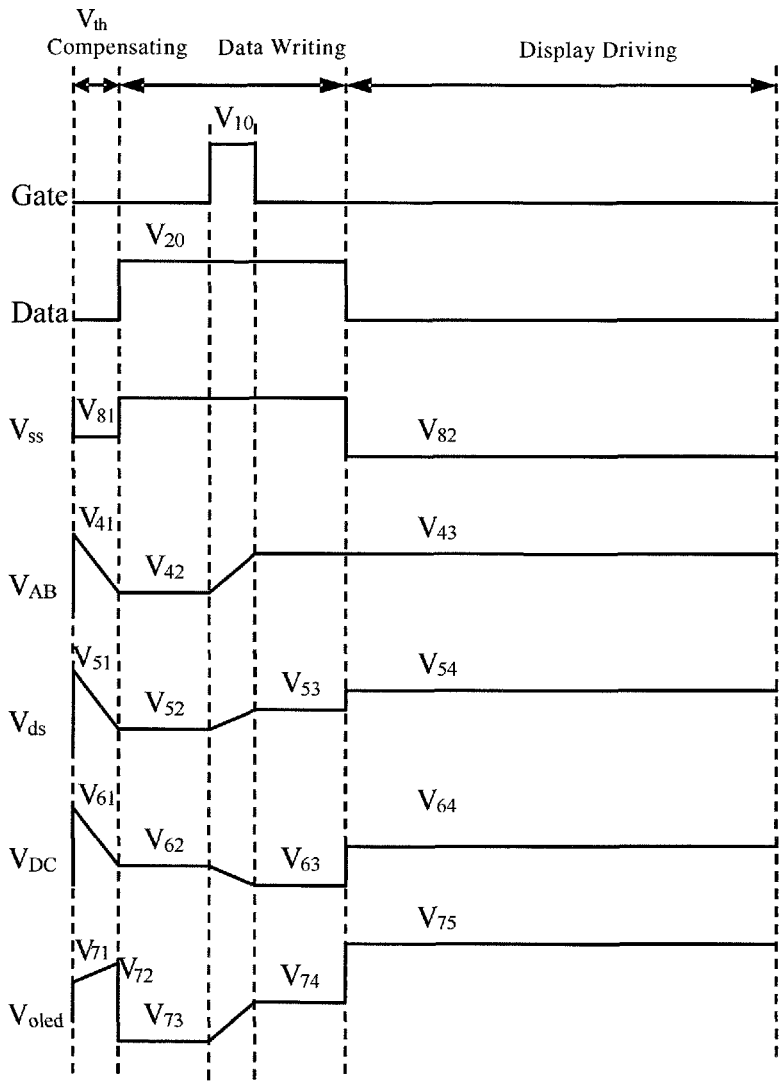
FIG. 5 is a diagram showing a driving sequence of a driving method performing by the voltage-driving pixel unit in FIG. 4.

In addition, a driving method with the voltage-driving pixel circuit according to this embodiment is further provided. FIG. 5 is a diagram showing the driving sequence of a driving method with the voltage-driving pixel unit in FIG. 4. As shown in FIG. 5, the driving method mainly comprises three sequences, i.e., the compensating sequence, the data-writing sequence and the display driving sequence. In the sequence diagram shown in FIG. 5, the following signals during one frame is displayed are illustrated: the selecting signal $V_{10}$ of the gate line 540; the data signal voltage $V_{20}$ of the data line 550, the voltage $V_{ss}$ of the ground terminal 520 (comprising the control voltage $V_{81}$ for voltage presetting and the control voltage $V_{82}$ for display driving); the voltage $V_{41}$, $V_{42}$ and $V_{43}$ of the voltage $V_{AB}$ of the storage capacitor 505 in the three respective sequences (the voltage $V_{AB}$ between the node A on one side of the storage capacitor 505 and the node B on the other side of the storage capacitor 505, and also the $V_{gs}$ of the driving transistor 504); the voltage $V_{51}$, $V_{52}$, $V_{53}$ and $V_{54}$ of the source-drain voltage of the driving transistor 504 respectively at the initial point and in the three sequences, i.e., $V_{ds}$; the voltage $V_{61}$, $V_{62}$, $V_{63}$ and $V_{64}$ of the source-drain voltage of the blocking transistor 503 respectively at the initial point and in three sequences, i.e., $V_{DC}$; the voltage $V_{71}$, $V_{72}$, $V_{73}$, $V_{74}$ and $V_{75}$ of the voltage $V_{oled}$ across the OLED 530 respectively at the initial point and in the three sequences.

The driving method in this embodiment is similar to that in the first embodiment. The process and mechanism of the threshold voltage-presetting sequence, the data-writing sequence and the display driving sequence, and the variation of $V_{gs}$ and $V_{ds}$ of the driving transistor 504, the variation of the voltage $V_{AB}$ of the storage capacitor 505, the variation of the source-drain voltage $V_{DC}$ of the blocking transistor 503 and the variation of the voltage $V_{oled}$ across the OLED 530 are similar to those in the first embodiment, and the details thereof are omitted here for simplicity. The second embodiment is different from the first embodiment in that, the voltage $V_{dd}$ supplied from the power source line 510 to the common anode of the OLED 530 is maintained to be stable in the driving process, while multi-level voltage signals are provided by the voltage Vss of the ground terminal 520 according to the different sequences of threshold voltage-presetting, data-writing and display driving. The voltage provided by the ground terminal 520 is a negative voltage.

According to the above-described driving method, the influence of the data signal voltage on the threshold voltage preset in the storage capacitor can be alleviated to a most degree by blocking the connection between the driving transistor and the power source line with the blocking transistor during the data-writing sequence, and thus the threshold voltage preset in the storage capacitor can be stably maintained and the data signal voltage can be precisely written. In addition, since the influence of the data signal voltage on the threshold voltage preset in the storage capacitor is alleviated during the data-writing sequence, the accuracy of the threshold voltage preset in the storage capacitor can be maintained, and the accuracy of the data signal voltage for controlling the brightness of the OLED can be maintained as well. In addition, since the driving current of the driving transistor is not associated with the threshold of the driving transistor, the brightness of the OLED merely depends on the data signal voltage, and thus the influence of the threshold voltage variation on the driving current and the brightness of the OLED can be reduced, especially the influence of the drift of the threshold voltage resulting from a long-time operation of the driving transistor can be greatly reduced.

In addition, an OLED display comprising the voltage-driving pixel unit according anyone of the above embodiments is also provided. In the OLED display, the voltage-driving pixel unit is provided on an array substrate.

The array substrate comprises a plurality of gate lines and a plurality of data lines. The gate lines and the data lines are intersected with each other to define a plurality of pixel regions for forming the voltage-driving pixel units. The array substrate may further comprise a row driving chip for providing voltage signals to the voltage-driving pixel units and a column driving chip for providing column signals. The OLED display may further comprise a circuit board and a structure for packaging the OLED display. The circuit board may be provided with a chip group, a voltage source and a voltage source for proving sequence-control signal to the row driving chip and the column driving chip.

The OLED display may be a common anode type or a common cathode type. In the OLED of the common cathode type, the cathode of the OLED in each pixel circuit is connected to a ground terminal, the ground terminals for the pixel circuits within the same row are connected together and then connected to the driving chip, and the control signals are provided by the driving chip. In addition, in the OLED display of the common anode type, the anode of the OLED in each pixel circuit is connected to a power source line, the power source lines for the pixel circuits within the same row are connected together and then connected to the driving chip, and the control signals are provided by the driving chip.

In the OLED display, the blocking transistor and the switching transistor in a pixel within the N-th row can be controlled by a common gate line, thus the design of the pixel circuit and the array substrate can be further simplified, the load on the power source can be reduced and the power consumption can be decreased.

It should be appreciated that the embodiments described above are intended to illustrate but not limit the present invention. Although the present invention has been described in detail herein with reference to the preferred embodiments, it should be understood by those skilled in the art that the present invention can be modified and some of the technical features can be equivalently substituted without departing from the spirit and scope of the present invention.

What is claimed is:

1. A voltage-driving pixel unit, comprising a voltage-driving pixel circuit and an organic light emitting diode (OLED) driven by the voltage-driving pixel circuit, wherein the voltage-driving pixel circuit comprises a gate line, a data line, a power source line, a ground terminal, a switching transistor, a driving transistor, a compensating transistor, a blocking transistor and a storage capacitor, wherein the switching transistor is used to control inputting of a data signal voltage from the data line, a gate electrode of the switching transistor is connected with the gate line, a drain electrode of the switching transistor is connected with the data line, and a source electrode of the switching transistor is connected with a gate electrode of the driving transistor;

the compensating transistor is used to pre-store an instant threshold voltage of the driving transistor to the storage capacitor, a gate electrode of the compensating transistor is directly connected with the power source line or a cathode of the OLED, a drain electrode of the compensating transistor is connected with a source electrode of the blocking transistor, and a source electrode of the compensating transistor is connected with source electrode of the switching transistor;

the driving transistor is used to provide a driving current to the OLED, a gate electrode of the driving transistor is connected with one side of the storage capacitor, and a source electrode of the driving transistor is connected with the other side of the storage capacitor; and the blocking transistor is used to block a connection between the driving transistor and the power source line, both a gate electrode and a drain electrode of the blocking transistor are directly connected with the power source line or the cathode of the OLED, and a source electrode of the blocking transistor is connected with a drain electrode of the driving transistor.

2. The voltage-driving pixel unit according to claim 1, wherein a cathode of the OLED is connected with the ground terminal, and an anode of the OLED is connected with the source electrode of the driving transistor.

3. The voltage-driving pixel unit according to claim 1, wherein an anode of the OLED is connected with the power source line, and the cathode of the OLED is directly connected with the gate and drain electrodes of the blocking transistor and the gate electrode of the compensating transistor.

4. An organic light emitting diode (OLED) display comprising the voltage-driving pixel unit according to claim 1, wherein the voltage-driving pixel unit is provided on an array substrate.

5. The OLED display according to claim 4, wherein a cathode of the OLED of the pixel unit on the array substrate is connected with the ground terminal.

6. The OLED display according to claim 4, wherein an anode of the OLED of the pixel unit on the array substrate is connected with the power source line.

7. The OLED display according to claim 4, wherein the array substrate is further provided with a row driving chip for providing voltage signal to the voltage-driving pixel unit and a column driving chip for providing current signal.

8. The OLED display according to claim 4, further comprising a circuit board and a structure for packaging the OLED display.

9. A driving method for a voltage-driving pixel unit, the voltage-driving pixel unit comprising a voltage-driving pixel circuit and an organic light emitting diode (OLED) driven by the voltage-driving pixel circuit, the voltage-driving pixel circuit comprising a gate line, a data line, a power source line, a ground terminal, a switching transistor, a driving transistor, a compensating transistor, a blocking transistor and a storage capacitor, the method comprising:

after supplying a high level signal via the power source line, thus storing a voltage larger than the threshold voltage of the driving transistor into the storage capacitor, and setting a cathode of the OLED to a high level, setting the power source to a low level, thus reversely biasing the OLED and turning on the driving transistor, step 1 of applying a low level signal to the gate line, applying a signal voltage to the power source line and the ground terminal respectively, thus directly turning on the compensating transistor and the blocking transistor and charging the storage capacitor to a threshold voltage of the driving transistor;

step 2 of applying a high level signal to the gate line and applying a signal voltage to the power source line and the ground terminal respectively, thus directly rendering the compensating transistor and the blocking transistor in an OFF state, turning on the switching transistor, and writing a data signal voltage from the data line to the storage capacitor; and step 3 of applying a low level signal to the gate line, applying a signal voltage to the power source line and the ground terminal respectively, thus directly turning on the blocking transistor and driving the OLED to emit light with the voltage stored in the storage capacitor.

10. The method according to claim 9, wherein applying a signal voltage to the power source line and the ground terminal respectively in the step 1 comprises applying a first high level signal to the power source line, and applying a low level signal to the ground terminal;

applying a signal voltage to the power source line and the ground terminal respectively in the step 2 comprises applying a low level signal to the power source line, and applying a high level signal to the ground terminal; and applying a signal voltage to the power source line and the ground terminal respectively in the step 3 comprises applying a second high level signal to the power source line, and applying a low level signal to the ground terminal.

11. The method according to claim 10, wherein the first high level signal is in the range of 2~5 V, and the second high level signal is in the range of 20~30 V.

* * * * *